US005979018A

United States Patent [19]

Albus et al.

[11] Patent Number: 5,979,018

[45] Date of Patent: Nov. 9, 1999

[54] COTTON GIN RIB

[76] Inventors: Daniel F. Albus, 5417 95th St., Lubbock, Tex. 79424; Russell B. Williams, 3303 60th St., Lubbock, Tex. 79413

[21] Appl. No.: 09/166,031

[22] Filed: Oct. 5, 1998

Related U.S. Application Data

[60] Provisional application No. 60/062,149, Oct. 9, 1997.

[51] Int. Cl.[6] ..... D01B 1/08

[52] U.S. Cl. ..... 19/62 R; 19/48 R

[58] Field of Search ..... 19/62 R, 48 R, 19/62 A, 55 R, 56

[56] References Cited

U.S. PATENT DOCUMENTS

| | | | |
|---|---|---|---|
| 9,429 | 2/1852 | Clark | 269/262 |
| 206,847 | 8/1878 | Williams | 19/62 R |
| 268,007 | 11/1882 | Garlington | 19/62 R |
| 269,091 | 12/1882 | Mitchell | 19/62 R |
| 510,073 | 12/1893 | Lemain | 19/62 R |
| 3,694,857 | 10/1972 | Nayfa | 19/62 |
| 4,625,365 | 12/1986 | Nayfa | 19/55 |
| 4,749,625 | 6/1988 | Obayashi et al. | 428/624 |
| 4,850,083 | 7/1989 | France | 19/62 |

*Primary Examiner*—Michael A. Neas
*Assistant Examiner*—Gary L. Welch
*Attorney, Agent, or Firm*—Wendell Coffee; Mark Scott

[57] ABSTRACT

A plastic gin rib is manufactured of nylon material with long glass fiber reinforcement and carbon fiber reinforcement. In some cases, synthetic resinous fluorine-containing polymers is added to the nylon before molding.

11 Claims, 1 Drawing Sheet

COTTON GIN RIB

CROSS REFERENCE TO RELATED APPLICATION:

Provisional Patent Application

Applicant filed a Provisional Application on this subject matter on Oct. 9, 1997, U.S. Pat. No. 60,062,149. Specific reference is made to that document.

BACKGROUND OF THE INVENTION (1) Field of the Invention

This invention relates to cotton gins and more particularly to gin rib which is used in a gin stand. The gin rib is a basic part of a basic machine of a cotton gin. The ribs and saws separate the lint from the seed. Cotton ginners have ordinary skill in this art.

(2) Description of the Related Art

Before this invention, cotton gin ribs were well known and almost universally made of cast iron or aluminum. Basically, the rib was cast and then hand ground to form a ginning point where saw teeth pull the fiber from the restrained seed.

Through years of development, the particular shape (as well as the spacing of the ginning point and the like) of the gin rib has been well defined. One of the problems with iron ribs is that they tend to rust during the dormant season. It is necessary for the proper operation of the cotton to move freely over the gin ribs; however, the rust inhibits this smooth movement.

A second problem is at times when the cotton gin is not in operation overnight or for two or three hours, the ribs tend to sweat or accumulate moisture. The moisture on the ribs has an adverse effect when the cotton starts flowing and moving over the ribs again.

Also because of different conditions, often the cotton on the gin rib will form wads of cotton, which tend to increase in size. These wads of cotton greatly increase the friction between themselves and the saw, resulting in the saw blade becoming extremely hot. A hot saw blade loses its temper and therefore loses its shape causing difficulties. Normally in such cases, the saw blade is ruined, either the entire assembly including 80 to 100 saws will require being removed and replaced. Otherwise the saw unit will require being dismantled and the individual saw blades replaced. This is time consuming and expensive during the ginning season.

Before this invention, it was known and suggested to put inserts at the ginning points. An example of an insert is shown in FRANCE U.S. Pat. No. 4,850,083 (Jul. 25, 1989) wherein a tungsten carbide insert was placed in the rib at the ginning point. Also, it had been suggested that plastic materials could be used for the ribs. NAYFA U.S. Pat. No. 3,696,857 (Oct. 3, 1972) is an example of such a development.

SUMMARY OF THE INVENTION (1) Progressive Contribution to the Art

This invention discloses a plastic rib. Plastic ribs may be readily injected, molded and produced at a greatly reduced cost than the metal ribs. In addition, the plastic ribs do not have the problems of rusting or attracting moisture. In addition, the rib, not the saw blade, will fail in case of a cotton wad causing heat. Although a pair of ribs will be ruined, they may be replaced. If the saw blade is not damaged, it is far less expensive and time consuming to replace the ribs than a ruined saw blade.

The requirements for the rib include:

1) the plastic must be rigid; and 2) the rib must be anti-static so cotton does not cling to it.

Also it would be desirable if the rib had a high degree of lubrication; meaning in the event of heat the rib exudes material that is a good lubricant or creates a slick surface to increase the flow or movement of cotton over the rib.

(2) Objects of this Invention

An object of this invention is to provide a plastic gin rib for cotton gins.

Further objects are to achieve the above with devices that are sturdy, compact, durable, lightweight, simple, safe, efficient, versatile, ecologically compatible, energy conserving, and reliable, yet inexpensive and easy to manufacture, install, operate, and maintain.

The specific nature of the invention, as well as other objects, uses, and advantages thereof, will clearly appear from the following description and from the accompanying drawings, the different views of which are not necessarily scale drawings.

Catalogue of Elements

Figure 1:
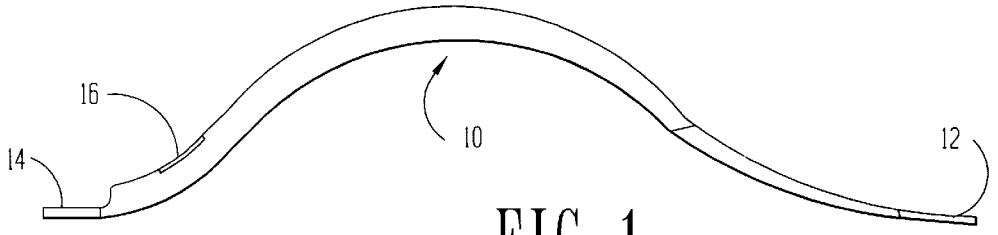
FIG. 1 is a side elevational view of a cotton gin rib according to this invention.

As an aid to correlating the terms of the claims to the exemplary drawing(s), the following catalog of elements and steps is provided:

10 gin rib. As seen in the drawings, the cavities do not extend to the outer exposed surface.
12 end
14 end
16 rib insert
18 end
20 end
22 longitudinal cavity or channel
116 gin point insert
118 tapered end
120 tapered end
122 cylindrical indentions

DESCRIPTION OF THE PREFERRED EMBODIMENTS(S)

Referring to FIG. 1, there may be seen a gin rib 10 according to this invention. It will be noted that it has two ends 12 and 14 which are flat with countersunk holes in them as is well known to the art. The ribs are made to be attached to the breast of a cotton gin. Also it may be seen that there is a rib insert 16 placed at the ginning point.

The gin rib 10 as shown in FIG. 1 would have the same configuration, size, and dimension as those commonly used which are made of metal.

Figure 2:
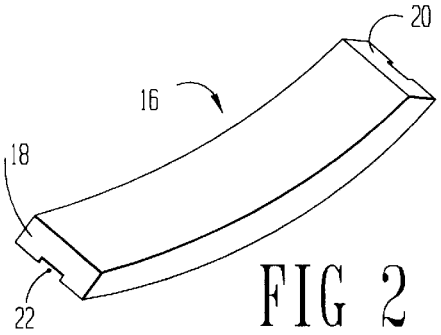
FIG. 2 is a perspective view of a gin point insert for the rib.
Figure 3:
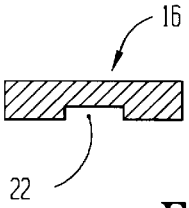
FIG. 3 is a sectional view of the ginning point insert as shown in FIG. 2.
Figure 4:
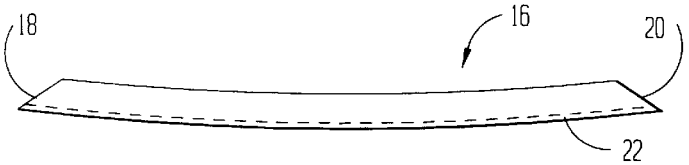
FIG. 4 is a side elevational view of the ginning point insert according to FIG. 2.

The preferred form of the insert 16 is shown in FIG. 2. The ends 18 and 20 are tapered at 45° so that they may readily be locked into the plastic rib 10 during the molding process. Also it will be noted that there is a longitudinal cavity or channel 22 cavity which extends for the length of the insert on the inner surface of the insert. This stabilizes the attachment of the insert to the rib after being molded. FIG. 3 is a cross-sectional view of the insert 16. FIG. 4 is a side elevational view.

Figure 6:
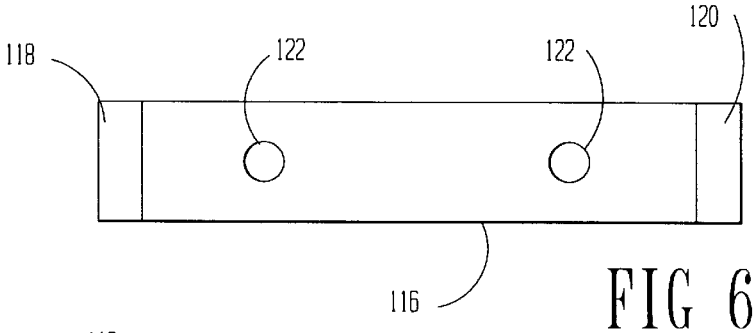
FIG. 6 is a plan view of the insert shown in FIG. 5.
Figure 5:
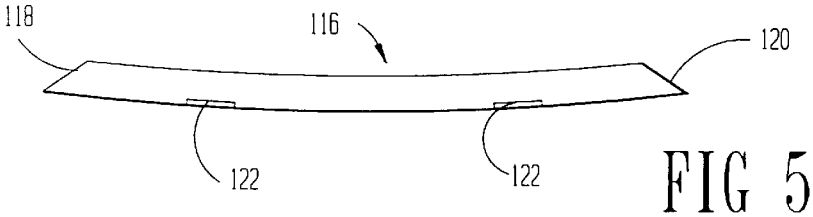
FIG. 5 is a side elevational view of a different embodiment of the gin point insert.

FIGS. 5 and 6 show a modified gin point insert 116. It may be seen that exposed surfaces are the same. Also the insert 116 has a 45° tapered ends 118 and 120. However, it will also be noted that there are no longitudinal channels, but two cylindrical indentions 122 or cavities have been made in the inner surface of the insert 116. These indentions, like the channel, are to stabilize the insert into the plastic rib.

The inserts have an outer exposed face or surface, which is shorter than the inner enclosed face or surface. The cavities aid in anchoring the insert to the rib. As seen in the drawings, the cavities do not extend to the outer exposed surface. The inserts are preferably made of chrome high carbon steel. The inserts have the same width as the ribs.

Referring to FIG. 3, it may be seen that the width of the channel is about one-third of the width of the insert. However, it will be understood that this is a matter of design choice. It is contemplated that the channel might be no more than one-twentieth of the width of the insert.

Those having ordinary skill in injection plastic molding will understand how the gin ribs could be molded. The ginning point inserts would be placed in the mold prior to the injection of the plastic so that with the injection of the plastic the inserts would be securely anchored to the molded gin rib.

It is found that basically a nylon based rib with about 20% long glass fiber reinforcement and 20% carbon fiber reinforcement works well. Also in some cases, it would be well to include some polytetrafluoroethylene fibers (such as Teflon) to reinforce the injected nylon.

It is found that Celstran N66G20C20-01-4, manufactured by Ticona a former subsidiary of Hoechst Technical Polymers of 90 Morris Avenue, Summit, N.J. 07901-3914 and which is distributed by Polymer Composites, Inc., P.O. Box 30010, 4610 Theurer Boulevard, Winona, Minn. 55987, appears suitable. It has 20% long glass fiber reinforcement and 20% carbon fiber reinforcement. This has a stock number from Polymer Composites of #FL0125.

Also it has been found that Verton RFL-8028/Themocomp RC-1008 is suitable. This is a heat stabilized nylon base with about 40% long glass fiber reinforcement; 10% synthetic resinous fluorine-containing polymers (such as Teflon) for lubrication; plus 10% carbon fiber. It is manufactured by LNP Engineering Plastics, Inc., 475 Creamery Way, Exton, Pa. 19341 and having a product code #753328806/753940070.

The embodiment shown and described above is only exemplary. We do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

We claim as our invention:

1. A cotton gin rib with a ginning point formed of plastic with a metal insert at the ginning point, said plastic being nylon and also including synthetic resinous fluorine-containing polymers reinforced with carbon fibers and glass fibers.

2. The rib as defined in claim 1 with at least 20% of the plastic is glass fiber reinforcement and at least 10% of the plastic is carbon fiber reinforcement.

3. The rib as defined in claim 2 wherein said metal insert is of the same width as the rib and is beveled on each end so an inner enclosed surface of the insert is longer than an outer exposed surface thereby locking the insert into said rib; and the inner surface has at least one cavity which does not extend to the outer exposed surface therein to anchor the insert to the plastic rib.

4. The rib as defined in claim 1 with approximately 20% of the plastic is glass fiber reinforcement and approximately 20% of the is carbon fiber reinforcement.

5. The rib as defined in claim 4 wherein said metal insert is of the same width as the rib and is beveled on each end so an inner enclosed surface of the insert is longer than an outer exposed surface thereby locking the insert into said rib; and the inner surface has at least one cavity which does not extend to the outer exposed surface therein to anchor the insert to the plastic rib.

6. The rib as defined in claim 1 with approximately 10% of the plastic is polytetrafluoroethylene, approximately 40% of the plastic is glass fiber reinforcement, and approximately 10% of the plastic is carbon fiber reinforcement.

7. The rib as defined in claim 6 wherein said metal insert is of the same width as the rib and is beveled on each end so an inner enclosed surface of the insert is longer than an outer exposed surface thereby locking the insert into said rib; and the inner surface has at least one cavity which does not extend to the outer exposed surface therein to anchor the insert to the plastic rib.

8. The rib as defined in claim 1 wherein said metal insert is of the same width as the rib and is beveled on each end so an inner enclosed surface of the insert is longer than an outer exposed surface thereby locking the insert into said rib; and the inner surface has at least one cavity which does not extend to the outer exposed surface therein to anchor the insert to the plastic rib.

9. A cotton gin rib with a ginning point formed of plastic with:

a) a metal insert at the ginning point, b) approximately 10% of the plastic is polytetrafluoroethylene, approximately 40% of the plastic is glass fiber reinforcement, and approximately 10% of the plastic is carbon fiber reinforcement, and c) the plastic also includes nylon.

10. The rib as defined in claim 9 wherein said metal insert is of the same width as the rib and is beveled on each end so an inner enclosed surface of the insert is longer than an outer exposed surface thereby locking the insert into said rib; and the inner surface has at least one cavity which does not extend to the outer exposed surface therein to anchor the insert to the plastic rib.

11. A cotton gin rib with a ginning point formed of plastic with:

a) a metal insert at the ginning point, and b) said metal insert is of the same width as the rib and is beveled on each end so an inner enclosed surface of the insert is longer than an outer exposed surface thereby locking the insert into said rib; and the inner surface has at least one cavity which does not extend to the outer exposed surface therein to anchor the insert to the plastic rib.

* * * * *